United States Patent [19]

Gin

[11] 4,453,711

[45] Jun. 12, 1984

[54] INFLATABLE BODY BREAKING GAME

[76] Inventor: Abram Gin, 99-46 63rd, Rego Park, N.Y. 11374

[21] Appl. No.: 348,834

[22] Filed: Feb. 16, 1982

[51] Int. Cl.[3] ..... A63F 9/00

[52] U.S. Cl. ..... 273/86 R; 446/220

[58] Field of Search ..... 273/86 R; 46/88, 90, 46/194

[56] References Cited

U.S. PATENT DOCUMENTS 1,421,238 6/1922 Hulsmann ..... 273/86 R 1,507,505 9/1924 Munn ..... 273/86 R

FOREIGN PATENT DOCUMENTS 1101127 4/1955 France ..... 273/86 R

*Primary Examiner*—Anton O. Oechsle

*Attorney, Agent, or Firm*—Ilya Zborovsky

[57] ABSTRACT

A game with inflatable bodies includes at least two inflatable bodies, a supporting element for supporting said inflatable bodies, and a breaking element arranged so that upon reaching s certain degree of inflation by the respective inflatable body it breaks by contact with the breaking element.

9 Claims, 3 Drawing Figures

INFLATABLE BODY BREAKING GAME

BACKGROUND OF THE INVENTION

The present invention relates to games. More particularly, it relates to a game involving inflatable bodies, such as baloons and the like.

There are many games with inflatable bodies. However, there is not game in which players can compete in the speed of inflating the inflatable bodies. There is also no game in which a winner in such a competition can be immediately recognized in an amusing and attractive manner. Since improvements in attractiveness of games are desirable as well as creation of new games, provision of a game with inflatable bodies which attains the above mentioned results is very desirable.

SUMMARY OF THE INVENTION

Accordingly, it is an object of the present invention to provide a game which avoids the disadvantages of the prior art.

More particularly, it is an object of the present invention to provide a game with inflatable bodies, which is very attractive to children.

In keeping with these objects and with others which will become apparent hereinafter, one feature of the present invention resides, briefly stated, in a game having at least two inflatable bodies, at least one supporting element arranged to support said inflatable bodies, and a breaking element arranged so that each of said inflatable bodies can be broken by said breaking element after a certain degree of inflation.

When the game is designed in accordance with the present invention, at least two players can inflate two inflatable bodies, and a winner will be determined upon which one of the player inflates his inflatable bodies to such a degree that his inflatable body breaks by contact with the breaking element.

The game is very attractive, competitive, and interesting not only for children, but also for adults.

The novel features of the present invention will be defined in the appended claims. The invention itself, however, both as to its construction and manner of playing, will best be understood from the following description of preferred embodiments accompanied by the following drawings.

DESCRIPTION OF PREFERRED EMBODIMENTS

Figure 1:
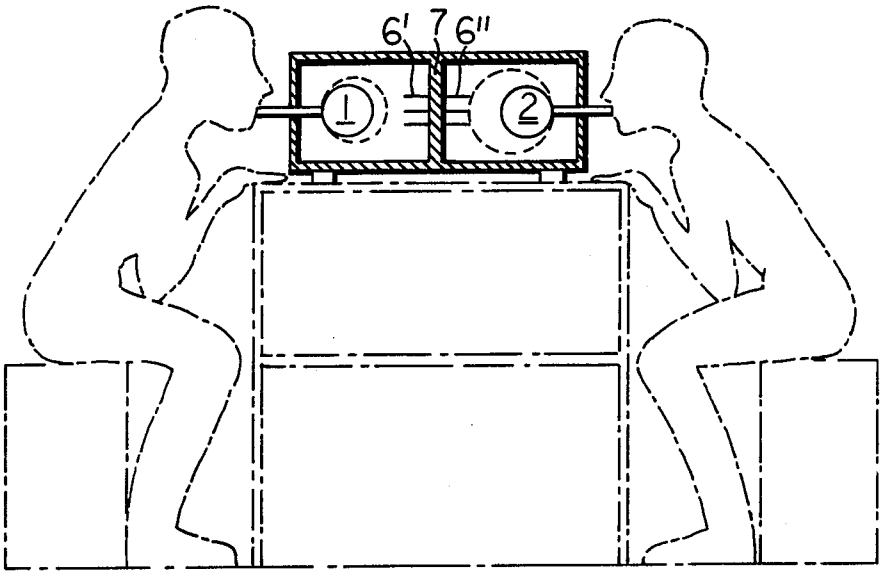
FIG. 1 is a side view showing a game with inflatable bodies in accordance with the present invention.

A game in accordance with the present invention has at least two inflatable bodies which are identified by reference numerals 1 and 2.

A supporting element identified in toto by reference numeral 3 is further provided. The supporting element 3 is formed for supporting the inflatable bodies 1 and 2. The supporting element 3 may include two supporting members 3' and 3'' each arranged for supporting a respective one of the inflatable bodies 1 and 2. For this purpose, the supporting members 3 and 3' have openings 4 through which a portion of the inflatable bodies 1 and 2 can pass.

The supporting members 3' and 3'' are connected with one another by a connecting element which is identified in toto by reference numeral 5 and includes two connecting members or walls 5' and 5''. The walls 5' and 5'' may form together with the members 3' and 3'', a substantially rectangular frame.

A breaking element 6 is further provided. It includes at least two breaking members 6' and 6'' facing toward the supporting members 3' and 3'' and correspondingly to the inflatable bodies 1 and 2, respectively. The breaking members 6' and 6'' may be formed of one piece with one another, for example as sharp nail-like bars or projections. A plurality of such breaking members 6' and 6'' may also be provided as can be seen from the drawings. They may be spaced from one another both in a vertical direction and in a horizontal direction.

Finally, a bearing member 7 formed as a wall is further provided. It extends between walls 5' and 5'' and supporting the breaking members 6' and 6''. As can be seen from the drawings, the supporting element 3 with its supporting members 3' and 3'' and connecting members 5' and 5'', on the one hand, and the breaking element 6 with its breaking members 6' and 6'' and bearing member 7, on the other hand, may be of one piece or connected with each other so as to form a unitary structure. On the other hand, they may be formed by separate members and connected (assembled) with each other.

In order to play game, a portion of the inflatable bodies 1 and 2 is inserted in the respective openings 4 so that an opening of the inflatable bodies are outside of the supporting members 3' and 3'' and the main part of the inflatable bodies are inside the latter. Each of two players starts to inflate the bodies 1 and 2. A winner will be a player whose inflatable body has been inflated so that it first contacts the breaking elements 6' or 6'', is pierced by the latter, and bursts.

Figure 3:
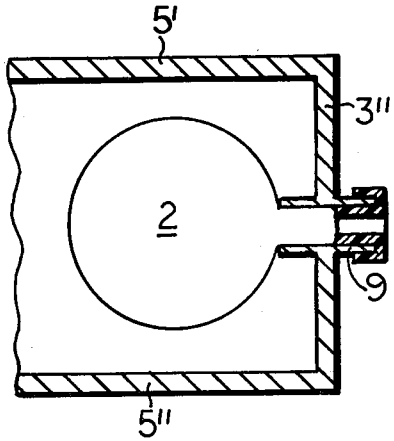
FIG. 3 is a view substantially corresponding to the view of FIG. 1, but showing the inventive game in accordance with another embodiment of the invention.
Figure 2:
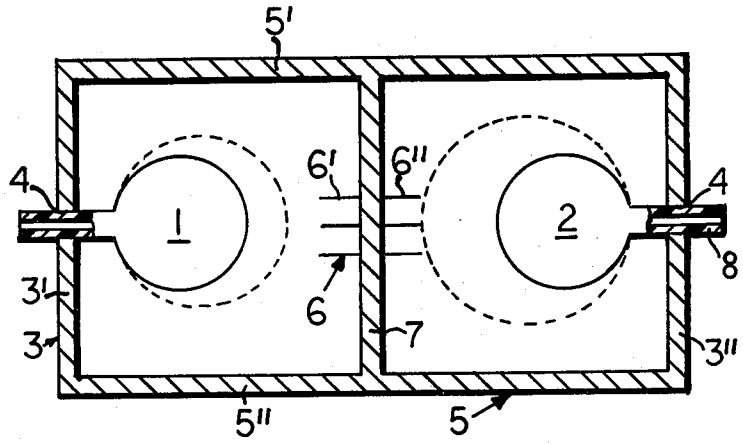
FIG. 2 is a plan view of the inventive game shown in FIG. 2.

FIG. 3 shows a somewhat different embodiment of the present invention. While for convenient holding and inflating of the inflatable bodies in FIG. 2 it is advisable to have the inflatable bodies with rigid mouthpieces 8, this is no longer needed in the construction shown in FIG. 3. In this construction the supporting members 3' and 3'' are provided with pipe-like guides 9 through which a portion of the inflatable bodies 1 and 2 can pass. The ends of these portions can be wound around the outer ends of the guides to provide for reliable holding of the inflatable bodies during inflation.

Although the game is illustrated in the drawing as suitable for two players, it can also be played by more than two players. In the latter case, a greater number of inflatable bodies are required, as well as a greater number of supporting members and breaking members. The supporting members may be arranged in the latter case not as opposite walls of the rectangular frame, but as a peripheral wall of a circular frame, etc.

The invention is not limited by the details shown since various modifications and structural changes are possible without departing in any way from the spirit of the present invention.

For example, it is possible to form for two or more players separate units each including a supporting element, a breaking element and an inflatable body.

I claim:

1. A game, comprising at least two inflatable bodies;

a supporting element arranged to support said two inflatable bodies;

a breaking element, said inflatable bodies being arranged at a predetermined distance from said breaking element in non-inflated condition; and means for inflating said inflatable bodies by at least two players, respectively, so that during inflation of said inflatable bodies by the players said inflatable bodies expand, overcome said distance, and break being pierced by said breaking element and therefore each of said inflatable bodies is broken as a result of its inflation by the respective player and finally piercing by said breaking element.

2. A game as defined in claim 1, wherein said supporting element includes two supporting members each arranged to support a respective one of said inflatable bodies.

3. A game as defined in claim 2, wherein said supporting element has a connecting member which connects said supporting members with one another.

4. A game as defined in claim 1, wherein said breaking element includes at least two breaking members each arranged to break a respective one of said inflatable bodies.

5. A game as defined in claim 4, wherein said breaking element includes a bearing members which carries said two breaking members.

6. A game as defined in claim 1, wherein said supporting element includes two supporting members each arranged to support a respective one of said inflatable bodies and a connecting member connecting said supporting member with one another, said breaking element including two breaking members each arranged to break a respective one of said inflatable bodies and a bearing member carrying said breaking members, said members of said supporting element being connected with said members of said breaking element so as to form together a unitary structure.

7. A game as defined in claim 2, wherein each of said inflatable bodies has an elongated mouthpiece, said supporting members having openings in which said elongated mouthpieces of said inflatable bodies are received.

8. A game as defined in claim 2, wherein each of said supporting members has an elongated pipe-like guide, said inflatable bodies having parts arranged to be received in said guides of said supporting members.

9. A game as defined in claim 1, wherein said supporting element includes at least two separate supporting members, said breaking element including at least two breaking members, each of said inflatable bodies forming together with a respective one of said breaking members and a respective one of said supporting members a separate unit.

* * * * *